US009916758B2

(12) United States Patent
Zou et al.

(10) Patent No.: US 9,916,758 B2
(45) Date of Patent: Mar. 13, 2018

(54) TRAFFIC LIGHT FOR COOPERATIVE VEHICLE INFRASTRUCTURE AND METHOD FOR CONTROLLING THE SAME WITH A MODULE CONFIGURED TO LOCATE THE POSITION OF THE TRAFFIC LIGHT

(71) Applicant: LEAUTO INTELLIGENT TECHNOLOGY (BEIJING) CO. LTD, Chaoyang District Beijing (CN)

(72) Inventors: Yu Zou, Chaoyang District Beijing (CN); Wenrui Li, Chaoyang District Beijing (CN); Yong Xu, Chaoyang District Beijing (CN); Kunsheng Chen, Chaoyang District Beijing (CN); Dan Li, Chaoyang District Beijing (CN); Wei Lin, Chaoyang District Beijing (CN); Peng Liu, Chaoyang District Beijing (CN)

(73) Assignee: LEAUTO INTELLIGENT TECHNOLOGY (BEIJING) CO. LTD., Beijing (CN)

( * ) Notice: Subject to any disclaimer, the term of this patent is extended or adjusted under 35 U.S.C. 154(b) by 73 days.

(21) Appl. No.: 14/978,254

(22) Filed: Dec. 22, 2015

(65) Prior Publication Data

US 2017/0154525 A1 Jun. 1, 2017

(30) Foreign Application Priority Data

Nov. 30, 2015 (CN) ..... 2015 1 0857278

(51) Int. Cl.

| | |
|---|---|
| ***G08B 21/00*** | (2006.01) |
| ***G08G 1/081*** | (2006.01) |
| ***G08G 1/01*** | (2006.01) |
| ***G08G 1/08*** | (2006.01) |
| ***G08G 1/095*** | (2006.01) |

(52) U.S. Cl.

CPC ..... *G08G 1/081* (2013.01); *G08G 1/0116* (2013.01); *G08G 1/0145* (2013.01); *G08G 1/08* (2013.01); *G08G 1/095* (2013.01)

(58) Field of Classification Search

CPC ..... G08G 1/081
USPC ..... 340/909, 910, 914, 916, 917
See application file for complete search history.

(56) References Cited

U.S. PATENT DOCUMENTS

2008/0204277 A1* 8/2008 Sumner ..... G08G 1/08 340/910

* cited by examiner

*Primary Examiner* — Jeffery Hofsass

(57) ABSTRACT

The present disclosure provides a traffic light for cooperative vehicle-infrastructure and a method for controlling the same. The traffic light for cooperative vehicle-infrastructure includes: a communication module, a central processing module, a Global Positioning System GPS module and a scheduling module. The communication module is configured to receive a set of messages sent by vehicles periodically. The GPS module is configured to locate the position of the traffic light. The central processing module is configured to perform calculations and analyses on the received set of messages and the position of the traffic light, dynamically set lasting times of red and green lamps of the traffic light, and send a control signal carrying the set times to the scheduling module. The scheduling module is configured to control the lasting times of the red and green lamps of traffic light according to the control signal carrying the set times.

20 Claims, 2 Drawing Sheets

TRAFFIC LIGHT FOR COOPERATIVE VEHICLE INFRASTRUCTURE AND METHOD FOR CONTROLLING THE SAME WITH A MODULE CONFIGURED TO LOCATE THE POSITION OF THE TRAFFIC LIGHT

CROSS-REFERENCE TO RELATED APPLICATIONS

This application is based upon and claims priority to Chinese Patent Application 201510857278.5, titled "a traffic light for cooperative vehicle-infrastructure and a method for controlling the same", filed Nov. 30, 2015, the entire contents of which are incorporated herein by reference.

FIELD OF TECHNOLOGY

The present disclosure generally relates to the technical field of traffic lights, and more particularly to a traffic light for cooperative vehicle-infrastructure and a method for controlling the same.

BACKGROUND

Traffic lights play an import role of directing traffic flows in cities. Currently, the time change periods of traffic lights are substantially predetermined, typically designed based on a principle that opportunities for crossing directions are equal. Further, in a condition where main roads and secondary roads intersect with each other, in view of larger traffic volumes on the main roads, the vehicle passing times of traffic lights are designed based on a principle that the vehicle passing times for the main roads are longer than that for the secondary roads. All the above approaches are based on equal opportunities or probabilities to control vehicle passing times, but do not consider real-time road conditions.

Recently, there are also designs which perform visual recognition on traffic flows and streams of people based on cameras to adjust traffic lights to change passing times at intersections and thereby to effectively improve traffic efficiency. However, the problem of such designs is that the cost for visual recognition is relatively high, and the recognition is not accurate due to the influence of rays of light and occlusions among vehicles.

SUMMARY

In view of the above problem, the present disclosure provides a traffic light for cooperative vehicle-infrastructure and a corresponding method for controlling the traffic light for cooperative vehicle-infrastructure so as to overcome, at least in part, the above problem.

According to an aspect of the present disclosure, there is provided a traffic light for cooperative vehicle-infrastructure, including a communication module, a Global Positioning System GPS module, a central processing module and a scheduling module;

wherein the communication module is configured to receive a set of messages sent by vehicles periodically, and send the set of messages to the central processing module;

wherein the GPS module is configured to locate the position of the traffic light for cooperative vehicle-infrastructure and send the position of the traffic light for cooperative vehicle-infrastructure to the central processing module;

wherein the central processing module is configured to perform calculations and analyses on the received set of messages and the position of the traffic light for cooperative vehicle-infrastructure, dynamically set lasting times of red and green lamps of the traffic light for cooperative vehicle-infrastructure according to calculations and analyses results, and send a control signal carrying the set times to the scheduling module; and wherein the scheduling module is configured to control the lasting times of the red and green lamps of traffic light for cooperative vehicle-infrastructure according to the control signal carrying the set times.

Optionally, the communication module is a V2X wireless communication module.

Optionally, the central processing module is further configured to: calculate relative positions of the vehicles with respect to the traffic light for cooperative vehicle-infrastructure and travel directions of the vehicles according to the set of messages and the position of the traffic light for cooperative vehicle-infrastructure, perform analyses and calculations to obtain traffic volumes at an intersection where the traffic light for cooperative vehicle-infrastructure is located, dynamically set the lasting times of the red and green lamps of the traffic light according to the traffic volumes, and send the control signal carrying the set times to the scheduling module. The travel directions of vehicles are directions in which the vehicles are traveling towards or away from the traffic light for cooperative vehicle-infrastructure.

Optionally, the central processing module is further configured to: if it is determined by analyses and calculations that a traffic volume in a first direction at the intersection is smaller than a traffic volume in a second direction at the intersection, shorten the lasting time of the green lamp in the first direction and lengthen the lasting time of the green lamp in the second direction at a next change of the red lamp.

Optionally, the traffic light for cooperative vehicle-infrastructure further has a periodic change function;

the central processing module is further configured to: if it is determined by analyses and calculations that the traffic volume in the first direction at the intersection is close to the traffic volume in the second direction at the intersection, send a recovering signal to the scheduling module;

the scheduling module is further configured to receive the recovering signal sent from the central processing module, and control the lasting times of the red and green lamps of the traffic light for cooperative vehicle-infrastructure according to the recovering signal to make the red and green lamps periodically change.

Optionally, the set of messages are a set of messages for dedicated short range communication and include the longitudes and latitudes, headings, speeds, accelerations and break signals of the vehicles.

According to another aspect of the present disclosure, there is provided a method for controlling a traffic light for cooperative vehicle-infrastructure, including:

receiving a set of messages sent by vehicles periodically;

locating the position of the traffic light for cooperative vehicle-infrastructure;

performing calculations and analyses on the received set of messages and the position of the traffic light for cooperative vehicle-infrastructure, dynamically setting lasting times of red and green lamps of the traffic light for cooperative vehicle-infrastructure according to calculations and analyses results, and sending a control signal carrying the set times; and controlling the lasting times of the red and green lamps of traffic light for cooperative vehicle-infrastructure according to the control signal carrying the set times.

Optionally, the receiving a set of messages sent by vehicles periodically further includes: receiving the set of messages sent by vehicles periodically via a V2X communication approach.

Optionally, the performing calculations and analyses on the received set of messages and the position of the traffic light for cooperative vehicle-infrastructure, dynamically setting lasting times of red and green lamps of the traffic light for cooperative vehicle-infrastructure according to calculations and analyses results, and sending a control signal carrying the set times, further includes:

calculating relative positions of the vehicles with respect to the traffic light for cooperative vehicle-infrastructure and travel directions of the vehicles according to the set of messages and the position of the traffic light for cooperative vehicle-infrastructure, performing analyses and calculations to obtain traffic volumes at an intersection where the traffic light for cooperative vehicle-infrastructure is located, dynamically setting the lasting times of the red and green lamps of the traffic light according to the traffic volumes, and sending the control signal carrying the set times, wherein the travel directions of vehicles are directions in which the vehicles are traveling towards or away from the traffic light for cooperative vehicle-infrastructure.

Optionally, the dynamically setting the lasting times of the red and green lamps of the traffic light according to the traffic volumes, further includes:

if it is determined by analyses and calculations that a traffic volume in a first direction at the intersection is smaller than a traffic volume in a second direction at the intersection, shortening the lasting time of the green lamp in the first direction and lengthening the lasting time of the green lamp in the second direction at a next change of the red lamp.

Optionally, the traffic light for cooperative vehicle-infrastructure further has a periodic change function;

the dynamically setting the lasting times of the red and green lamps of the traffic light according to the traffic volumes, further includes:

if it is determined by analyses and calculations that the traffic volume in the first direction at the intersection is close to the traffic volume in the second direction at the intersection, sending a recovering signal; and the controlling the lasting times of the red and green lamps of traffic light for cooperative vehicle-infrastructure according to the control signal carrying the set times, further includes:

controlling the lasting times of the red and green lamps of the traffic light for cooperative vehicle-infrastructure according to the recovering signal to make the red and green lamps periodically change.

Optionally, the set of messages are a set of messages for dedicated short range communication and include the longitudes and latitudes, headings, speeds, accelerations and break signals of the vehicles.

In technical solutions provided by the present disclosure, a communication module receives a set of messages sent by vehicles periodically, and sends the set of messages to a central processing module; a GPS module locates the position of the traffic light for cooperative vehicle-infrastructure and sends the position of the traffic light for cooperative vehicle-infrastructure to the central processing module; the central processing module performs calculations and analyses on the received set of messages and the position of the traffic light for cooperative vehicle-infrastructure, dynamically sets lasting times of red and green lamps of the traffic light for cooperative vehicle-infrastructure according to calculations and analyses results, and sends a control signal carrying the set times to a scheduling module; the scheduling module controls the lasting times of the red and the green lamps of traffic light according to the control signal carrying the set times. Thus, real-time analyses on traffic volumes at an intersection is realized, lasting times of red and green lamps of the traffic light for cooperative vehicle-infrastructure are adjusted dynamically and in real-time, and thereby traffic efficiency is improved.

The above illustration is only a general description of the technical solutions provided by the present disclosure, aiming at making the technical means of the present disclosure understood more clearly and thereby practiced based on the contents of the specification. Further, in order to make the above and other objects, features and advantages of the present disclosure more obvious, specific implementations of the present disclosure will be exemplified below.

BRIEF DESCRIPTION OF THE DRAWINGS

One of ordinary skill in this art will appreciate other advantages from the following detailed description of exemplary embodiments herein. Drawings are only for showing exemplary embodiments but not for limiting the scope of the present disclosure. Through the drawings, similar reference numbers represent similar elements.

DESCRIPTION OF THE EMBODIMENTS

Exemplary embodiments of the present disclosure will be described below in detail with reference to drawings. Even though exemplary embodiments of the present disclosure are presented in drawings, it shall be appreciated that the present disclosure may be practiced in various manners without being limited to the embodiments set forth herein. Instead, the embodiments are provided herein to make the present disclosure be understood more thoroughly and to more completely convey the scope of the present disclosure to one of ordinary skill in this art.

The traffic light for cooperative vehicle-infrastructure in the present disclosure may be used for intersections of roads to direct vehicles to pass the intersections. The traffic light for cooperative vehicle-infrastructure has a function for periodic change and a function for dynamically setting lasting times of red and green lamps. The periodic change function of the traffic light for cooperative vehicle-infrastructure refers to that the lasting times of the red and green lamps are fixed, and the lasting times of the red and green lamps at a previous time point are the same with that at a next time point. The function for dynamically setting the lasting times of red and green lamps refers to that the lasting times of the red and green lamps are adjustable, and the lasting times of the red and green lamps at a previous time point differ from that at a next time point.

Figure 1:
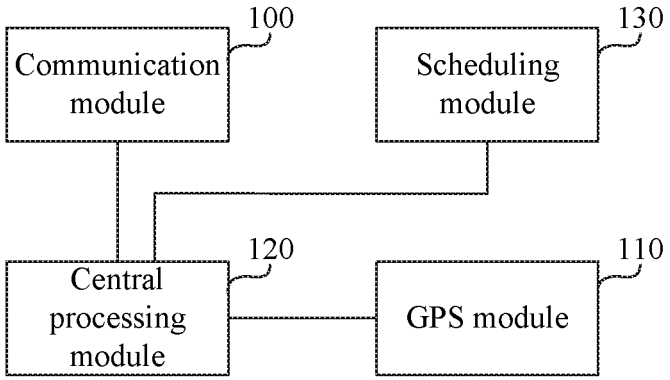
FIG. 1 is a block diagram showing a structure of a traffic light for cooperative vehicle-infrastructure according to an embodiment of the present disclosure.

FIG. 1 is a block diagram showing a structure of a traffic light for cooperative vehicle-infrastructure according to an embodiment of the present disclosure. The traffic light for cooperative vehicle-infrastructure includes a communication module 100, a Global Positioning System GPS module 110, a central processing module 120 and a scheduling module 130.

The communication module 100 is configured to receive a set of messages sent by vehicles periodically, and send the set of messages to the central processing module.

Optionally, the communication module is a V2X wireless communication module. V2X (Vehicle-to-X) refers to communication between vehicles and devices surrounding the vehicles. The X includes vehicles, road-side units and service stations and the like. Currently, the wireless communication technologies for the V2X wireless communication module follow an IEEE 802.11P protocol, with a designed transmission distance of 300-1000 m and a transmission rate of 3M to 27M bps. The V2X wireless communication module may be applied in fields such as smart traffics and active safety for driving. The V2X wireless communication module has advantages such as high real-time performance, no need of base stations, avoidance of operator traffic and charging problems.

Specifically, when vehicles travel into a road where the traffic light for cooperative vehicle-infrastructure is located, the vehicles may send a set of messages periodically to the V2X wireless communication module of the traffic light for cooperative vehicle-infrastructure via V2X wireless communication modules of the vehicles, for example, sending a set of messages every 50 ms. The set of messages are a set of messages for dedicated short range communication (DSRC), which includes the longitudes and latitudes, headings, speeds, accelerations and break signals of the vehicles. The longitude and latitude of a vehicle may be used for accurately calculate the position of the vehicle, and the heading of a vehicle refers to a direction for the vehicle travelling on the road, for example, traveling from the south to the north.

After receiving the set of messages sent from the vehicles, the V2X wireless communication module sends the set of messages to the central processing module for processing.

The GPS module 110 is configured to locate the position of the traffic light for cooperative vehicle-infrastructure and send the position of the traffic light for cooperative vehicle-infrastructure to the central processing module.

Specifically, the GPS module 110 locates the position of the traffic light for cooperative vehicle-infrastructure, obtains the position of the traffic light for cooperative vehicle-infrastructure, and sends the obtained position of the traffic light for cooperative vehicle-infrastructure to the central processing module for processing.

The central processing module 120 is configured to perform calculations and analyses on the received set of messages and the position of the traffic light for cooperative vehicle-infrastructure, dynamically set lasting times of red and green lamps of the traffic light for cooperative vehicle-infrastructure according to calculations and analyses results, and send a control signal carrying the set times to the scheduling module.

Specifically, after receiving the set of messages sent from the communication module and the position of the traffic light for cooperative vehicle-infrastructure sent from the GPS module, the central processing module 120 performs calculations and analyses by combining the set of messages and the position of the traffic light for cooperative vehicle-infrastructure. For example, the central processing module 120 may perform calculations and analyses to obtain traffic volumes at an intersection where the traffic light for cooperative vehicle-infrastructure is located, dynamically set the lasting times of the red and green lamps of the traffic light for cooperative vehicle-infrastructure according to calculations and analyses results, for example, shortening or lengthening the lasting times of the red and green lamps, and send a control signal carrying the set times to the scheduling module.

Optionally, the central processing module is further configured to: calculate relative positions of the vehicles with respect to the traffic light for cooperative vehicle-infrastructure and travel directions of the vehicles according to the set of messages and the position of the traffic light for cooperative vehicle-infrastructure, perform analyses and calculations to obtain traffic volumes at an intersection where the traffic light for cooperative vehicle-infrastructure is located, dynamically set the lasting times of the red and green lamps of the traffic light according to the traffic volumes, and send the control signal carrying the set times to the scheduling module. The travel directions of vehicles are directions in which the vehicles are travelling towards or away from the traffic light for cooperative vehicle-infrastructure. For example, if it is appreciated to the central processing module by calculations and analyses that there are a large number of vehicles at the traffic light for cooperative vehicle-infrastructure, and the travel directions of the vehicles are traveling away from the traffic light for cooperative vehicle-infrastructure, the central processing module may shorten the lasting time of the green lamp of the traffic light for cooperative vehicle-infrastructure in the direction; if it is appreciated to the central processing module by calculations and analyses that there are a large number of vehicles at the traffic light for cooperative vehicle-infrastructure, and the travel directions of the vehicles are traveling towards the traffic light for cooperative vehicle-infrastructure, the central processing module may lengthen the lasting time of the green lamp of the traffic light for cooperative vehicle-infrastructure in the direction.

Specifically, the central processing module may calculate the position of each vehicle according to the longitude and latitude and speed of the vehicle, and calculate the relative position of the vehicle with respect to the traffic light for cooperative vehicle-infrastructure and the travel direction of the vehicle by combining the position of the traffic light for cooperative vehicle-infrastructure and the heading of the vehicle, and thereby determine whether the vehicle is travelling towards or away from the traffic light for cooperative vehicle-infrastructure. After calculating the positions of all the vehicles at the intersection where the traffic light for cooperative vehicle-infrastructure is located, the central processing module may perform calculations and analyses to obtain traffic volumes at the intersection where the traffic light for cooperative vehicle-infrastructure is located according to the positions of all the vehicles and the position of the traffic light for cooperative vehicle-infrastructure, dynamically set the lasting times of the red and green lamps of the traffic light for cooperative vehicle-infrastructure according to the traffic volumes, and send a control signal carrying the set times to the scheduling module. The traffic volumes refer to traffic volumes at the traffic light for cooperative vehicle-infrastructure when the travel directions of the vehicles are travelling towards the traffic light for cooperative vehicle-infrastructure.

The central processing module is further configured to: if it is determined by analyses and calculations that a traffic volume in a first direction at the intersection is smaller than a traffic volume in a second direction at the intersection, shorten the lasting time of the green lamp in the first direction and lengthen the lasting time of the green lamp in the second direction at a next change of the red lamp.

Taking an intersection where a south-north direction road intersects with an east-west direction road as an example, the first direction is the south-north direction, and the second direction is the east-west direction. If it is determined by analyses and calculations that a traffic volume in the south-north direction at the intersection is smaller than a traffic volume in the east-west direction at the intersection, the lasting time of the green lamp in the south-north direction is shortened and the lasting time of the green light in the east-west direction is lengthened at a next change of the red lamp. That is to say, when the green lamp of the traffic light for cooperative vehicle-infrastructure in the east-west direction is on, the lasting time of the green lamp in the east-west direction is lengthened, and the vehicle passing time is extended; at the same time, the red lamp of the traffic light for cooperative vehicle-infrastructure in the south-north direction is on, the lasting time of the red lamp in the south-north direction is lengthened, and the vehicle waiting time is extended.

In the embodiment, the central processing module may determine by analyses whether to reserve passing time for vehicles in a certain direction at the intersection according to the accelerations and speeds in the set of messages. For example, if the green lamp in a certain direction is on and it is obtained by analyses and calculations that the vehicles are travelling in very high accelerated speed, it indicates that the vehicles are about to pass the intersection. Even though the central processing module determines by analyses that the traffic volume in the direction is relatively small, the green lamp of the traffic light for cooperative vehicle-infrastructure shall not be promptly switched to the red lamp but a certain time shall be reserved to allow the vehicles to pass.

The scheduling module 130 is configured to control the lasting times of the red and the green lamps of traffic light according to the control signal carrying the set times.

Specifically, after receiving the control signal carrying the set times sent from the central processing module, the scheduling module controls the lasting times of the red and green lamps of traffic light for cooperative vehicle-infrastructure according to the control signal carrying the set times. For example, if the traffic volume in the south-north direction at the intersection is smaller than the traffic volume in the east-west direction at the intersection, the central processing module sets the lasting time of the green lamp of the traffic light for cooperative vehicle-infrastructure in the south-north direction as 20 s, the lasting time of the red lamp in the south-north direction as 60 s; and the central processing module sets the lasting time of the green lamp of the traffic light for cooperative vehicle-infrastructure in the east-west direction as 60 s, and the lasting time of the red lamp in the east-west direction as 20 s. In this way, the central processing module dynamically changes the passing time of the traffic light at the intersection. Thus, the technical solution may improve traffic efficiency, and may avoid the situation that the passing time is relatively long in a direction at an intersection where there is a small traffic volume, but no vehicle is about to pass, and on the contrary, the vehicles in a direction at the intersection where there is a large traffic volume have to wait unnecessarily.

Optionally, the central processing module is further configured to: if it is determined by analyses and calculations that the traffic volume in the first direction at the intersection is close to the traffic volume in the second direction at the intersection, send a recovering signal to the scheduling module.

Taking an intersection where a south-north direction road intersects with an east-west direction road as an example, the first direction is the south-north direction, and the second direction is the east-west direction. If it is determined by analyses and calculations that the traffic volume in the south-north direction at the intersection is close to the traffic volume in the east-west direction at the intersection, the central processing module sends a recovering signal to the scheduling module so as to make the red and green lamps to recover to periodic change at a next change of the red lamp.

The scheduling module is further configured to receive the recovering signal sent from the central processing module, and control the lasting time of the red and green lamps of the traffic light for cooperative vehicle-infrastructure according to the recovering signal to make the red and green lamps periodically change.

For example, when the red and green lamps of the traffic light for cooperative vehicle-infrastructure are changing periodically, and the lasting times of the red and green lamps are 30 s for the red lamp and 30 s for the green lamp. If the traffic volume in the south-north direction at the intersection is close to the traffic volume in the east-west direction at the intersection, the scheduling module controls the lasting times of the red and green lamps of the traffic light for cooperative vehicle-infrastructure to make the red and green lamps periodically change.

In the present embodiment, by periodically sending of the set of messages, the traffic light for cooperative vehicle-infrastructure may calculates the positions of vehicles in real-time, and thereby may perform calculations and analyses to obtain the traffic volumes at the intersection where the traffic light for cooperative vehicle-infrastructure is located. Thus, dynamic and real-time setting of the lasting times of the red and green lamps of the traffic light for cooperative vehicle-infrastructure is realized.

In the traffic light for cooperative vehicle-infrastructure provided by the above embodiments of the present disclosure, a communication module receives a set of messages sent by vehicles periodically, and sends the set of messages to a central processing module; a GPS module locates the position of the traffic light for cooperative vehicle-infrastructure and sends the position of the traffic light for cooperative vehicle-infrastructure to the central processing module; the central processing module performs calculations and analyses on the received set of messages and the position of the traffic light for cooperative vehicle-infrastructure, dynamically sets lasting times of red and green lamps of the traffic light according to calculations and analyses results, and sends a control signal carrying the set times to a scheduling module; the scheduling module controls the lasting times of the red and the green lamps of traffic light for cooperative vehicle-infrastructure according to the control signal carrying the set times. Thus, real-time analyses on traffic volumes at an intersection is realized, lasting times of red and green lamps of the traffic light for cooperative vehicle-infrastructure are adjusted dynamically and in real-time, and thereby traffic efficiency is improved.

Figure 2:
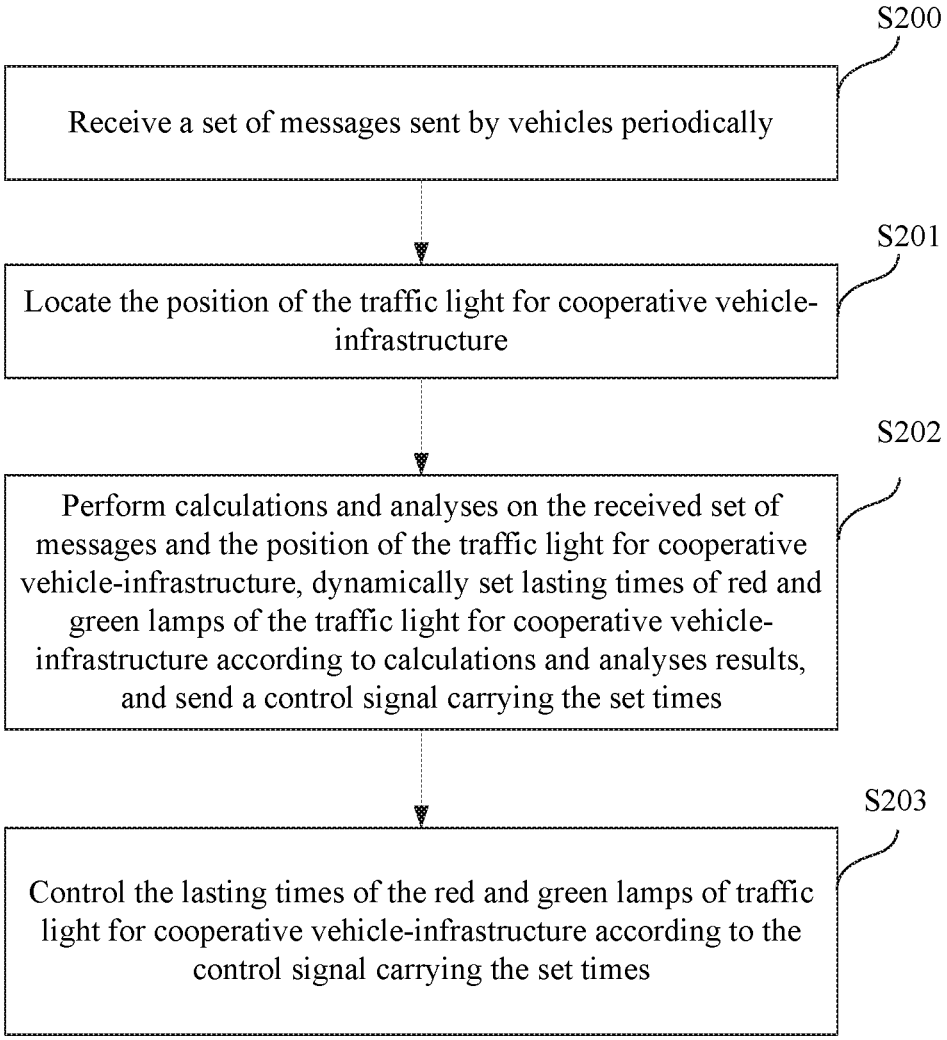
FIG. 2 is a flowchart showing a method for controlling a traffic light for cooperative vehicle-infrastructure according to an embodiment of the present disclosure.

FIG. 2 is a flowchart showing a method for controlling a traffic light for cooperative vehicle-infrastructure according to an embodiment of the present disclosure. As shown in FIG. 2, the method includes the following steps.

In step S200, a set of messages sent by vehicles periodically are received.

Specifically, when vehicles travel into a road where the traffic light for cooperative vehicle-infrastructure is located, the vehicles may send a set of messages periodically to a communication module of the traffic light for cooperative vehicle-infrastructure, for example, sending a set of messages every 50 ms. The communication module receives the set of messages sent by vehicles periodically.

In step S201, the position of the traffic light for cooperative vehicle-infrastructure is located.

Specifically, a GPS module locates the position of the traffic light for cooperative vehicle-infrastructure, obtains the position of the traffic light for cooperative vehicle-infrastructure, and sends the obtained position of the traffic light for cooperative vehicle-infrastructure to a central processing module for processing.

In step S202, calculations and analyses are performed on the received set of messages and the position of the traffic light for cooperative vehicle-infrastructure, lasting times of red and green lamps of the traffic light for cooperative vehicle-infrastructure are dynamically set according to calculations and analyses results, and control signal carrying the set times is sent.

Specifically, after receiving the set of messages sent from the communication module and the position of the traffic light for cooperative vehicle-infrastructure sent from the GPS module, the central processing module performs calculations and analyses by combining the set of messages and the position of the traffic light for cooperative vehicle-infrastructure. For example, the central processing module may perform calculations and analyses to obtain traffic volumes at an intersection where the traffic light for cooperative vehicle-infrastructure is located, dynamically set the lasting times of the red and green lamps of the traffic light for cooperative vehicle-infrastructure according to calculations and analyses results, for example, shortening or lengthening the lasting times of the red and green lamps, and send a control signal carrying the set times to a scheduling module.

In step S203, the lasting times of the red and green lamps of traffic light for cooperative vehicle-infrastructure are controlled according to the control signal carrying the set times.

In method provided by the above embodiments of the present disclosure, a set of messages sent by vehicles periodically are received, the position of the traffic light for cooperative vehicle-infrastructure is located, calculations and analyses are performed on the received set of messages and the position of the traffic light for cooperative vehicle-infrastructure, lasting times of red and green lamps of the traffic light for cooperative vehicle-infrastructure are dynamically set according to calculations and analyses results, a control signal carrying the set times is sent, and the lasting times of the red and the green lamps of traffic light are controlled according to the control signal carrying the set times. Thus, real-time analyses on traffic volumes at an intersection is realized, lasting times of red and green lamps of the traffic light for cooperative vehicle-infrastructure are adjusted dynamically and in real-time, and thereby traffic efficiency is improved.

Figure 3:
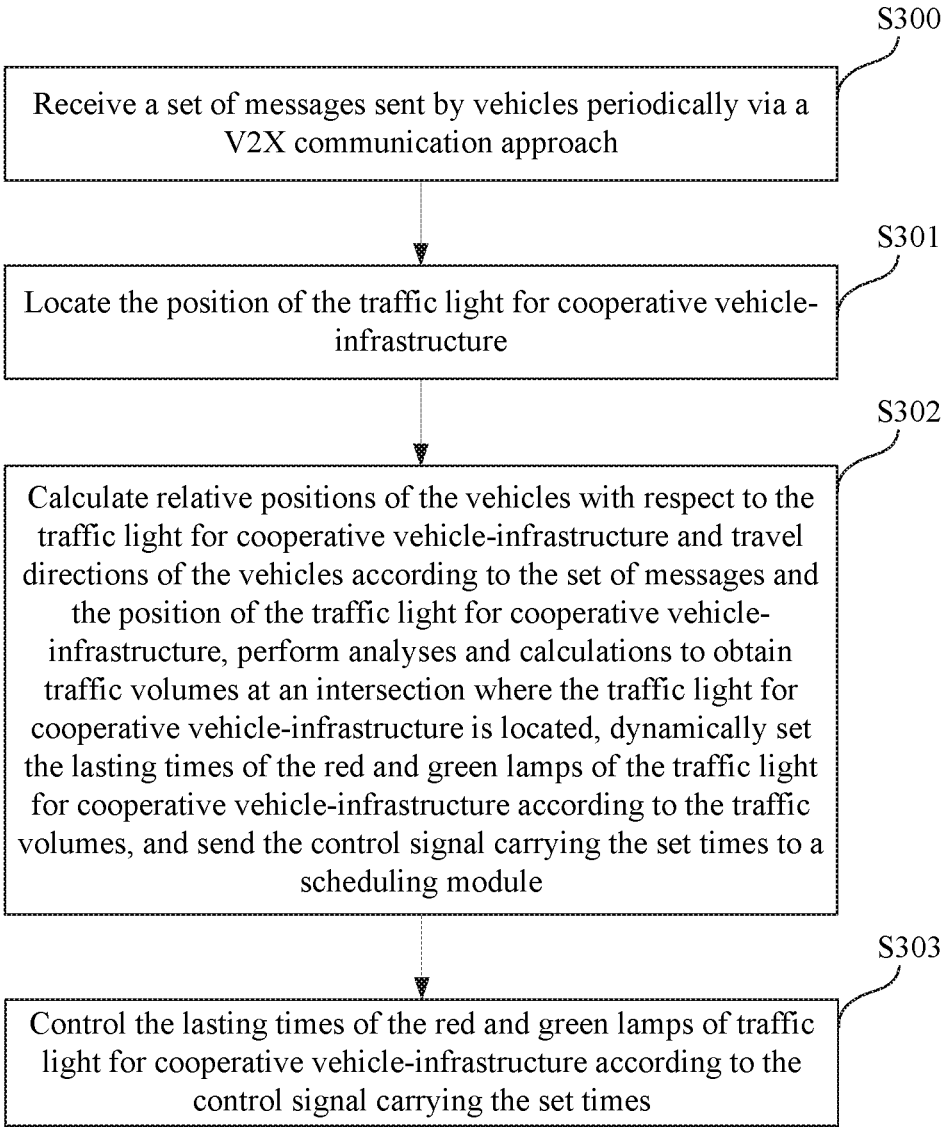
FIG. 3 is a flowchart showing a method for controlling a traffic light for cooperative vehicle-infrastructure according to another embodiment of the present disclosure.

FIG. 3 is a flowchart showing a method for controlling a traffic light for cooperative vehicle-infrastructure according to another embodiment of the present disclosure. As shown in FIG. 3, the method includes the following steps.

In step S300, a set of messages sent by vehicles periodically are received via a V2X communication approach.

V2X (Vehicle-to-X) refers to communication between vehicles and devices surrounding the vehicles. The X includes vehicles, road-side units and service stations and the like. Currently, the wireless communication technologies for the V2X wireless communication module follow an IEEE 802.11P protocol, with a designed transmission distance of 300-1000 m and a transmission rate of 3M to 27M bps. The V2X wireless communication may be applied in fields such as smart traffics and active safety for driving. The V2X wireless communication has advantages such as high real-time performance, no need of base stations, avoidance of operator traffic and charging problems.

Specifically, when vehicles travel into a road where the traffic light for cooperative vehicle-infrastructure is located, the vehicles may send a set of messages periodically to a V2X wireless communication module of the traffic light for cooperative vehicle-infrastructure via V2X wireless communication modules of the vehicles, for example, sending a set of messages every 50 ms. The set of messages are a set of messages for dedicated short range communication (DSRC), which includes the longitudes and latitudes, headings, speeds, accelerations and break signals of the vehicles. The longitude and latitude of a vehicle may be used for accurately calculate the position of the vehicle, and the heading of a vehicle refers to a direction for the vehicle travelling on the road, for example, traveling from the south to the north.

After receiving the set of messages sent from the vehicles, the V2X wireless communication module sends the set of messages to a central processing module for processing.

In step S301, the position of the traffic light for cooperative vehicle-infrastructure is located.

In step S302, relative positions of the vehicles with respect to the traffic light for cooperative vehicle-infrastructure and travel directions of the vehicles are calculated according to the set of messages and the position of the traffic light for cooperative vehicle-infrastructure, analyses and calculations are performed to obtain traffic volumes at an intersection where the traffic light for cooperative vehicle-infrastructure is located, the lasting times of the red and green lamps of the traffic light for cooperative vehicle-infrastructure are dynamically set according to the traffic volumes, and the control signal carrying the set times is sent to a scheduling module.

The travel directions of vehicles are directions in which the vehicles are traveling towards or away from the traffic light for cooperative vehicle-infrastructure.

For example, if it is appreciated to the central processing module by calculations and analyses that there are a large number of vehicles at the traffic light for cooperative vehicle-infrastructure, and the travel directions of the vehicles are traveling away from the traffic light for cooperative vehicle-infrastructure, the central processing module may shorten the lasting time of the green lamp of the traffic light for cooperative vehicle-infrastructure in the direction; if it is appreciated to the central processing module by calculations and analyses that there are a large number of vehicles at the traffic light for cooperative vehicle-infrastructure, and the travel directions of the vehicles are traveling towards the traffic light for cooperative vehicle-infrastructure, the central processing module may lengthen the lasting time of the green lamp of the traffic light for cooperative vehicle-infrastructure in the direction.

Specifically, the central processing module may calculate the position of each vehicle according to the longitude and latitude and speed of the vehicle, and calculate the relative position of the vehicle with respect to the traffic light for cooperative vehicle-infrastructure and the travel direction of the vehicle by combining the position of the traffic light for cooperative vehicle-infrastructure and the heading of the vehicle, and thereby determine whether the vehicle is travelling towards or away from the traffic light for cooperative vehicle-infrastructure. After calculating the positions of all the vehicles at the intersection where the traffic light for cooperative vehicle-infrastructure is located, the central processing module may perform calculations and analyses to obtain traffic volumes at the intersection where the traffic light for cooperative vehicle-infrastructure is located according to the positions of all the vehicles and the position of the traffic light for cooperative vehicle-infrastructure, dynamically set the lasting times of the red and green lamps of the traffic light for cooperative vehicle-infrastructure according to the traffic volumes, and send a control signal carrying the set times to the scheduling module. The traffic volumes here refer to traffic volumes at the traffic light for cooperative vehicle-infrastructure when the travel directions of the vehicles are travelling towards the traffic light for cooperative vehicle-infrastructure.

The central processing module is further configured to: if it is determined by analyses and calculations that a traffic volume in a first direction at the intersection is smaller than a traffic volume in a second direction at the intersection, shorten the lasting time of the green lamp in the first direction and lengthen the lasting time of the green lamp in the second direction at a next change of the red lamp.

Taking an intersection where a south-north direction road intersects with an east-west direction road as an example, the first direction is the south-north direction, and the second direction is the east-west direction. If it is determined by analyses and calculations that a traffic volume in the south-north direction at the intersection is smaller than a traffic volume in the east-west direction at the intersection, the lasting time of the green lamp in the south-north direction is shortened and the lasting time of the green light in the east-west direction is lengthened at a next change of the red lamp. That is to say, when the green lamp of the traffic light for cooperative vehicle-infrastructure in the east-west direction is on, the lasting time of the green lamp in the east-west direction is lengthened, and the vehicle passing time is extended; at the same time, the red lamp of the traffic light for cooperative vehicle-infrastructure in the south-north direction is on, the lasting time of the red lamp in the south-north direction is lengthened, and the vehicle waiting time is extended.

In the embodiment, the central processing module may determine by analyses whether to reserve passing time for vehicles in a certain direction at the intersection according to the accelerations and speeds in the set of messages. For example, if the green lamp in a certain direction is on and it is obtained by analyses and calculations that the vehicles are travelling in very high accelerated speed, it indicates that the vehicles are about to pass the intersection. Even though the central processing module determines by analyses that the traffic volume in the direction is relatively small, the green lamp of the traffic light for cooperative vehicle-infrastructure shall not be promptly switched to the red lamp but a certain time shall be reserved to allow the vehicles to pass.

In step S303, the lasting times of the red and the green lamps of traffic light are controlled according to the control signal carrying the set times.

Specifically, after receiving the control signal carrying the set times sent from the central processing module, the scheduling module controls the lasting times of the red and green lamps of traffic light for cooperative vehicle-infrastructure according to the control signal carrying the set times. For example, if the traffic volume in the south-north direction at the intersection is smaller than the traffic volume in the east-west direction at the intersection, the central processing module sets the lasting time of the green lamp of the traffic light for cooperative vehicle-infrastructure in the south-north direction as 20 s, the lasting time of the red lamp in the south-north direction as 60 s; and the central processing module sets the lasting time of the green lamp of the traffic light for cooperative vehicle-infrastructure in the east-west direction as 60 s, and the lasting time of the red lamp in the east-west direction as 20 s. In this way, the central processing module dynamically changes the passing time of the traffic light at the intersection. Thus, the technical solution may improve traffic efficiency, and may avoid the situation that the passing time is relatively long in a direction at an intersection where there is a small traffic volume, but no vehicle is about to pass, and on the contrary, the vehicles in a direction at the intersection where there is a large traffic volume have to wait unnecessarily.

Optionally, the traffic light for cooperative vehicle-infrastructure further has a periodic change function.

If it is determined by analyses and calculations that the traffic volume in the first direction at the intersection is close to the traffic volume in the second direction at the intersection, the method according to the embodiment may further includes: sending a recovering signal to the scheduling module.

Taking an intersection where a south-north direction road intersects with an east-west direction road as an example, the first direction is the south-north direction, and the second direction is the east-west direction. If it is determined by analyses and calculations that the traffic volume in the south-north direction at the intersection is close to the traffic volume in the east-west direction at the intersection, the central processing module sends a recovering signal to the scheduling module so as to make the red and green lamps to recover to periodic change at a next change of the red lamp.

The lasting time of the red and green lamps of the traffic light for cooperative vehicle-infrastructure are controlled according to the recovering signal to make the red and green lamps periodically change.

For example, when the red and green lamps of the traffic light for cooperative vehicle-infrastructure are changing periodically, and the lasting times of the red and green lamps are 30 s for the red lamp and 30 s for the green lamp. If the traffic volume in the south-north direction at the intersection is close to the traffic volume in the east-west direction at the intersection, the scheduling module controls the lasting times of the red and green lamps of the traffic light for cooperative vehicle-infrastructure to make the red and green lamps periodically change.

In the method provided by the above embodiments of the present disclosure, a set of messages periodically sent by vehicles are received via a V2X communication approach, the position of the traffic light for cooperative vehicle-infrastructure is located, relative positions of the vehicles with respect to the traffic light for cooperative vehicle-infrastructure and travel directions of the vehicles are calculated according to the set of messages and the position of the traffic light for cooperative vehicle-infrastructure, analyses and calculations are performed to obtain traffic volumes at an intersection where the traffic light for cooperative vehicle-infrastructure is located, the lasting times of the red and green lamps of the traffic light are dynamically set according to the traffic volumes, the control signal carrying the set times is to a scheduling module, and the lasting times of the red and the green lamps of traffic light are controlled according to the control signal carrying the set times. Thus, real-time analyses on traffic volumes at an intersection is realized, lasting times of red and green lamps of the traffic light for cooperative vehicle-infrastructure are adjusted dynamically and in real-time, and thereby traffic efficiency is improved.

The above description has presented and illustrated many exemplary embodiments of the present disclosure, and however, as stated above, it shall be appreciated that the present disclosure is not limited to the implementations disclosed herein, providing these exemplary embodiments shall not be deemed as excluding other embodiments. Instead, the technical solutions in the present disclosure may be applied in any other combinations, variations and environments, and may be modified based on the above teaching or technologies or knowledge in related fields within the conceiving scope of the present disclosure. Any modifications or changes performed by one of ordinary skill in this art without departing from the spirit and scope of the present disclosure shall fall within the protection scope as defined by appended claims.

What is claimed is:

1. A traffic light for cooperative vehicle-infrastructure, comprising a communication module, a Global Positioning System GPS module, a central processing module and a scheduling module;

wherein the communication module is configured to receive a set of messages sent by vehicles periodically, and send the set of messages to the central processing module;

wherein the GPS module is configured to locate the position of the traffic light for cooperative vehicle-infrastructure and send the position of the traffic light for cooperative vehicle-infrastructure to the central processing module;

wherein the central processing module is configured to perform calculations and analyses on the received set of messages and the position of the traffic light for cooperative vehicle-infrastructure, dynamically set lasting times of red and green lamps of the traffic light for cooperative vehicle-infrastructure according to calculations and analyses results, and send a control signal carrying the set times to the scheduling module; and wherein the scheduling module is configured to control the lasting times of the red and green lamps of traffic light for cooperative vehicle-infrastructure according to the control signal carrying the set times.

2. The traffic light for cooperative vehicle-infrastructure according to claim 1, wherein the communication module is a V2X wireless communication module.

3. The traffic light for cooperative vehicle-infrastructure according to claim 1, wherein the central processing module is further configured to: calculate relative positions of the vehicles with respect to the traffic light for cooperative vehicle-infrastructure and travel directions of the vehicles according to the set of messages and the position of the traffic light for cooperative vehicle-infrastructure, perform analyses and calculations to obtain traffic volumes at an intersection where the traffic light for cooperative vehicle-infrastructure is located, dynamically set the lasting times of the red and green lamps of the traffic light according to the traffic volumes, and send the control signal carrying the set times to the scheduling module; and wherein the travel directions of vehicles are directions in which the vehicles are traveling towards or away from the traffic light for cooperative vehicle-infrastructure.

4. The traffic light for cooperative vehicle-infrastructure according to claim 2, wherein the central processing module is further configured to: calculate relative positions of the vehicles with respect to the traffic light for cooperative vehicle-infrastructure and travel directions of the vehicles according to the set of messages and the position of the traffic light for cooperative vehicle-infrastructure, perform analyses and calculations to obtain traffic volumes at an intersection where the traffic light for cooperative vehicle-infrastructure is located, dynamically set the lasting times of the red and green lamps of the traffic light according to the traffic volumes, and send the control signal carrying the set times to the scheduling module; and wherein the travel directions of vehicles are directions in which the vehicles are traveling towards or away from the traffic light for cooperative vehicle-infrastructure.

5. The traffic light for cooperative vehicle-infrastructure according to claim 3, wherein the central processing module is further configured to: if it is determined by analyses and calculations that a traffic volume in a first direction at the intersection is smaller than a traffic volume in a second direction at the intersection, shorten the lasting time of the green lamp in the first direction and lengthen the lasting time of the green lamp in the second direction at a next change of the red lamp.

6. The traffic light for cooperative vehicle-infrastructure according to claim 4, wherein the central processing module is further configured to: if it is determined by analyses and calculations that a traffic volume in a first direction at the intersection is smaller than a traffic volume in a second direction at the intersection, shorten the lasting time of the green lamp in the first direction and lengthen the lasting time of the green lamp in the second direction at a next change of the red lamp.

7. The traffic light for cooperative vehicle-infrastructure according to claim 3, wherein the traffic light for cooperative vehicle-infrastructure further has a periodic change function;

wherein the central processing module is further configured to: if it is determined by analyses and calculations that the traffic volume in the first direction at the intersection is close to the traffic volume in the second direction at the intersection, send a recovering signal to the scheduling module; and wherein the scheduling module is further configured to receive the recovering signal sent from the central processing module, and control the lasting times of the red and green lamps of the traffic light for cooperative vehicle-infrastructure according to the recovering signal to make the red and green lamps periodically change.

8. The traffic light for cooperative vehicle-infrastructure according to claim 4, wherein the traffic light for cooperative vehicle-infrastructure further has a periodic change function;

wherein the central processing module is further configured to: if it is determined by analyses and calculations that the traffic volume in the first direction at the intersection is close to the traffic volume in the second direction at the intersection, send a recovering signal to the scheduling module; and wherein the scheduling module is further configured to receive the recovering signal sent from the central processing module, and control the lasting times of the red and green lamps of the traffic light for cooperative vehicle-infrastructure according to the recovering signal to make the red and green lamps periodically change.

9. The traffic light for cooperative vehicle-infrastructure according to claim 1, wherein the set of messages are a set of messages for dedicated short range communication and comprise the longitudes and latitudes, headings, speeds, accelerations and break signals of the vehicles.

10. The traffic light for cooperative vehicle-infrastructure according to claim 2, wherein the set of messages are a set of messages for dedicated short range communication and comprise the longitudes and latitudes, headings, speeds, accelerations and break signals of the vehicles.

11. The traffic light for cooperative vehicle-infrastructure according to claim 3, wherein the set of messages are a set of messages for dedicated short range communication and comprise the longitudes and latitudes, headings, speeds, accelerations and break signals of the vehicles.

12. The traffic light for cooperative vehicle-infrastructure according to claim 4, wherein the set of messages are a set of messages for dedicated short range communication and comprise the longitudes and latitudes, headings, speeds, accelerations and break signals of the vehicles.

13. A method for controlling a traffic light for cooperative vehicle-infrastructure, comprising:

receiving a set of messages sent by vehicles periodically;

locating the position of the traffic light for cooperative vehicle-infrastructure;

performing calculations and analyses on the received set of messages and the position of the traffic light for cooperative vehicle-infrastructure, dynamically setting lasting times of red and green lamps of the traffic light for cooperative vehicle-infrastructure according to calculations and analyses results, and sending a control signal carrying the set times; and controlling the lasting times of the red and green lamps of traffic light for cooperative vehicle-infrastructure according to the control signal carrying the set times.

14. The method according to claim 13, wherein the receiving a set of messages sent by vehicles periodically further comprises: receiving the set of messages sent by vehicles periodically via a V2X communication approach.

15. The method according to claim 13, wherein the performing calculations and analyses on the received set of messages and the position of the traffic light for cooperative vehicle-infrastructure, dynamically setting lasting times of red and green lamps of the traffic light for cooperative vehicle-infrastructure according to calculations and analyses results, and sending a control signal carrying the set times, further comprises:

calculating relative positions of the vehicles with respect to the traffic light for cooperative vehicle-infrastructure and travel directions of the vehicles according to the set of messages and the position of the traffic light for cooperative vehicle-infrastructure, performing analyses and calculations to obtain traffic volumes at an intersection where the traffic light for cooperative vehicle-infrastructure is located, dynamically setting the lasting times of the red and green lamps of the traffic light according to the traffic volumes, and sending the control signal carrying the set times ; and wherein the travel directions of vehicles are directions in which the vehicles are traveling towards or away from the traffic light for cooperative vehicle-infrastructure.

16. The method according to claim 14, wherein the performing calculations and analyses on the received set of messages and the position of the traffic light for cooperative vehicle-infrastructure, dynamically setting lasting times of red and green lamps of the traffic light for cooperative vehicle-infrastructure according to calculations and analyses results, and sending a control signal carrying the set times, further comprises:

calculating relative positions of the vehicles with respect to the traffic light for cooperative vehicle-infrastructure and travel directions of the vehicles according to the set of messages and the position of the traffic light for cooperative vehicle-infrastructure, performing analyses and calculations to obtain traffic volumes at an intersection where the traffic light for cooperative vehicle-infrastructure is located, dynamically setting the lasting times of the red and green lamps of the traffic light according to the traffic volumes, and sending the control signal carrying the set times and wherein the travel directions of vehicles are directions in which the vehicles are traveling towards or away from the traffic light for cooperative vehicle-infrastructure.

17. The method according to claim 15, wherein the dynamically setting the lasting times of the red and green lamps of the traffic light according to the traffic volumes, further comprises:

if it is determined by analyses and calculations that a traffic volume in a first direction at the intersection is smaller than a traffic volume in a second direction at the intersection, shortening the lasting time of the green lamp in the first direction and lengthening the lasting time of the green lamp in the second direction at a next change of the red lamp.

18. The method according to claim 15, wherein the traffic light for cooperative vehicle-infrastructure further has a periodic change function;

wherein the dynamically setting the lasting times of the red and green lamps of the traffic light according to the traffic volumes, further comprises:

if it is determined by analyses and calculations that the traffic volume in the first direction at the intersection is close to the traffic volume in the second direction at the intersection, sending a recovering signal; and wherein the controlling the lasting times of the red and green lamps of traffic light for cooperative vehicle-infrastructure according to the control signal carrying the set times, further comprises:

controlling the lasting times of the red and green lamps of the traffic light for cooperative vehicle-infrastructure according to the recovering signal to make the red and green lamps periodically change.

19. The method according to claim 13, wherein the set of messages are a set of messages for dedicated short range communication and comprise the longitudes and latitudes, headings, speeds, accelerations and break signals of the vehicles.

20. The method according to claim 14, wherein the set of messages are a set of messages for dedicated short range communication and comprise the longitudes and latitudes, headings, speeds, accelerations and break signals of the vehicles.

* * * * *